US005397969A

United States Patent [19]

Roussel et al.

[11] Patent Number: 5,397,969

[45] Date of Patent: Mar. 14, 1995

[54] MAGNETIC FOCUSING DEVICE FOR CATHODE RAY TUBES

[75] Inventors: Bruno F. Roussel, Genlis; Jean M. Perreaut, Dijon, both of France

[73] Assignee: Thomson Tubes and Displays, S.A., Paris, France

[21] Appl. No.: 973,818

[22] Filed: Nov. 9, 1992

[51] Int. Cl.[6] ..... G09G 1/04; H01J 29/46

[52] U.S. Cl. ..... 315/382; 313/442

[58] Field of Search ..... 315/382, 399; 335/210, 335/212, 213; 250/396 ML; 313/442, 443

[56] References Cited

U.S. PATENT DOCUMENTS 4,245,159 1/1981 Beisswenger ..... 315/382

4,912,405 3/1990 Richardson ..... 250/396 ML

*Primary Examiner*—Gregory C. Issing

*Attorney, Agent, or Firm*—Joseph S. Tripoli; Joseph J. Laks; Harvey D. Fried

[57] ABSTRACT

A magnetic focusing device is disposed around the neck of a cathode ray tube. The device comprises a magnetic frame formed by constituent pieces having different magnetic permeabilities and having a gap in a portion thereof radially closest to the neck. A static focusing coil is enclosed in the frame and energized by a direct current. A dynamic focusing coil is energized by a periodically variable current and disposed between the static coil and the neck of the tube. The dynamic focusing coil is disposed near the gap and uses as a magnetic circuit the portion of the frame consisting of the material whose imaginary component of magnetic permeability is the lowest.

15 Claims, 4 Drawing Sheets

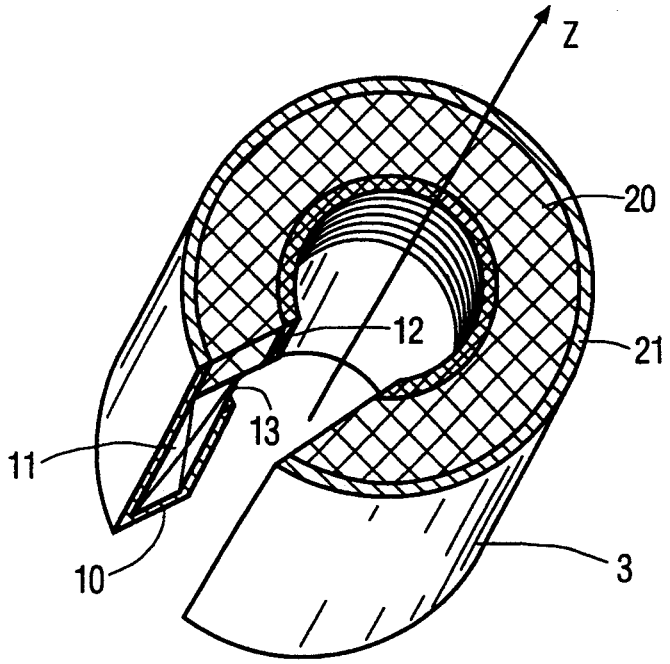
FIG. 5
FIG. 6
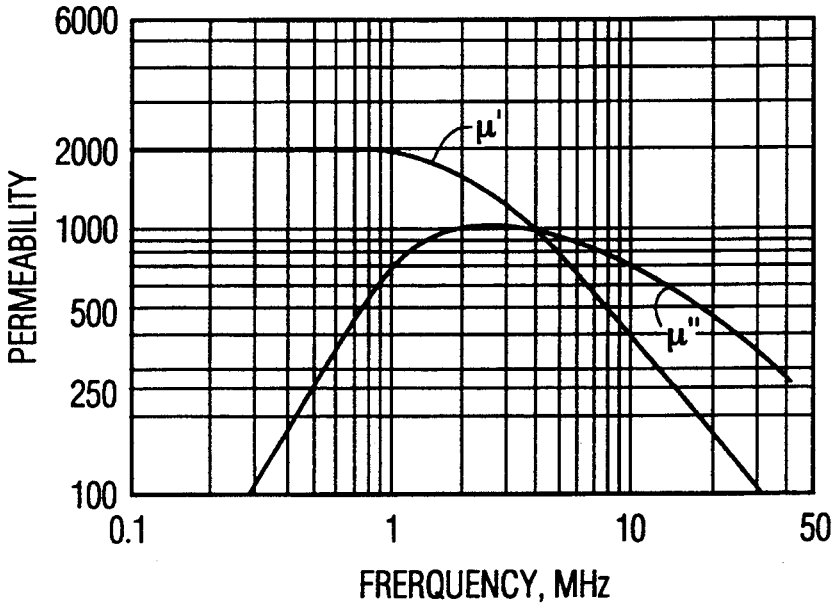

MAGNETIC FOCUSING DEVICE FOR CATHODE RAY TUBES

BACKGROUND OF THE INVENTION

The present invention relates to a cathode ray tube having an electron gun and a device for magnetic focusing of the electron beam issuing from said gun.

Magnetic focusing units are normally intended for use with cathode ray tubes of high resolution. Owing to the creation of a magnetic field coaxial with the electron beam issuing from the gun, they permit making the impact of this beam on the screen of the tube as small as desired.

Such tubes are used, for example, in the field of television by projection or professional display devices of high resolution. The focusing lens created by the magnetic focusing device can be realized either by means of a permanent magnet or by means of a circular winding enclosed in a magnetic circuit having a gap in which a possibly adjustable direct current flows.

It may be necessary to add a dynamic focusing coil to the main focusing coil in order to focus the electron beam over the entire surface of the screen of the tube with the same precision. In that case, the field created by the dynamic focusing coil will modulate the field of the main focusing coil depending on the position of the point of impact of the beam on the screen. The frequency of the current inside the auxiliary coil is the same as the line scan frequency of the screen. This presents certain problems at high scanning frequencies, for example, on the order of 16 kHz or higher, including:

(1) strong electric coupling between the main static coil and the dynamic coil;

(2) strong current, induced by the dynamic focusing coil, in the frame of the magnetic circuit containing the static focusing coil, hence a loss of energy;

(3) appearance of magnetic drag, due to the time for establishment of the field in the magnetic circuit, becoming critical at high scanning frequencies; and, (4) ever weaker action of the dynamic field on the electron beam as the scanning frequency increases.

SUMMARY OF THE INVENTION

The object of the present invention is to provide a magnetic focusing device for cathode ray tubes having a dynamic focusing coil operating at line scan frequencies on the order of 16 kHz or higher, in which the faults of magnetic drag, coupling between static coil and dynamic coil, and electrical and magnetic losses do not reach critical values.

The focusing device according to the invention comprises a static focusing coil traversed by a direct current and a dynamic focusing coil traversed by a variable periodic current. The focusing device comprises a frame having parts thereof characterized by different magnetic permeabilities.

BRIEF DESCRIPTION OF THE DRAWINGS

FIG. 5 is a perspective view, partly cut away, of the device of FIG. 4*a.*

FIG. 6 represents the variations of the real and imaginary components of the complex permeability of ferrite, pressed hot, as a function of the operating frequency.

DETAILED DESCRIPTION OF THE PREFERRED EMBODIMENTS

The focal distance f of a magnetic focusing lens is given by the following expression, in which H(z) is the magnetic field created along the main axis Z of the tube and k is a coefficient dependent on the geometric configuration of the system:

$$(1/f) = k \int_{-\infty}^{+\infty} H^2(Z)\, dz$$

If the field H(z) is modulated by a field variable in time, a so-called dynamic field, the above expression becomes:

$$(1/f) = k \int_{-\infty}^{+\infty} (H(z) + h(z))^2\, dz,$$

or also:

$$(1/f) = k \int_{-\infty}^{+\infty} H^2(z)\, dz + 2H(z)h(z)dz + h^2(z)dz$$

In principle it is desirable to effect modulation of the field H(z) with a dynamic field h(z) which is as small as possible, in order to save as much energy as possible. In this connection, if $h << H$, the term $h^2(z)dz$ becomes negligible with respect to the other two terms and the focal distance variation introduced by the modulation of the field H can be given by the expression:

$$\int_{-\infty}^{+\infty} 2H(z)h(z)dz$$

It can be seen that the dynamic focusing coil will be more efficient as the zones of action of the fields H and h along the axis Z overlap.

Figure 1:
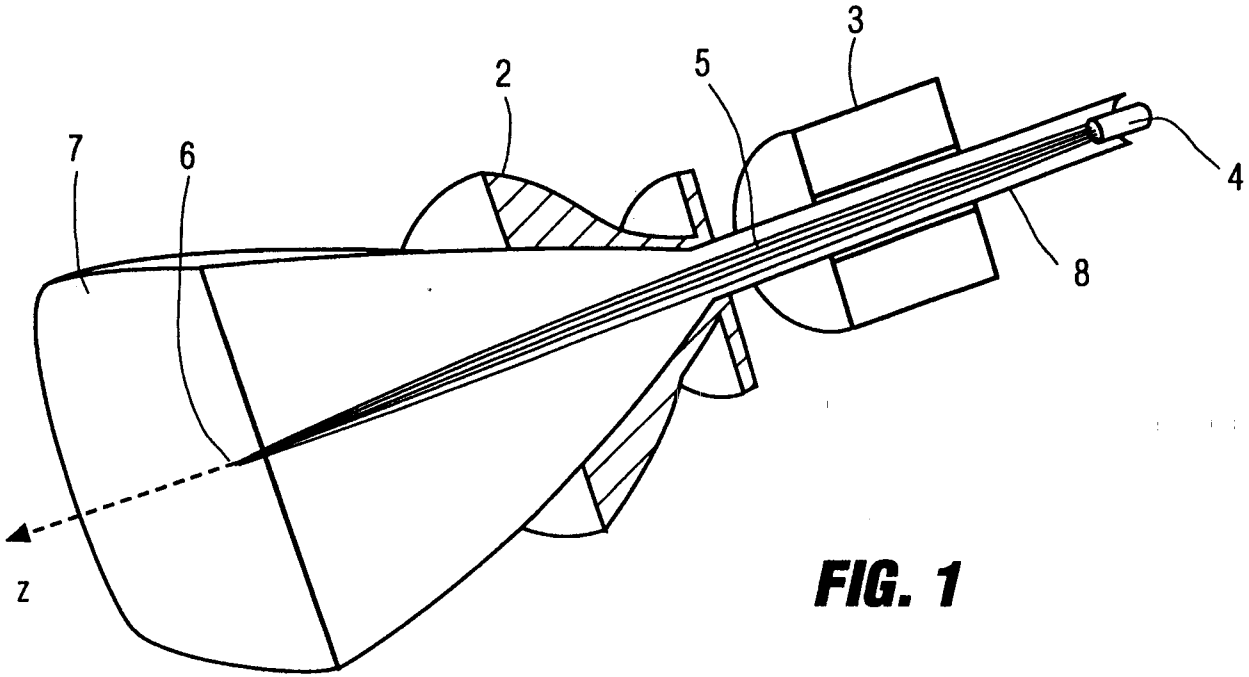
FIG. 1 is a perspective view, partly in section, of a cathode ray tube including a magnetic focusing system according to the invention.

FIG. 1 shows a cathode ray tube 1 having a deflection device 2 of the electron beam 5 issuing from the electron gun 4 and intended to cause the impact point 6 of beam 5 on the screen 7 of the tube to scan the entire surface thereof. This tube further has a magnetic focusing device 3 for the electron beams, which device is placed on the neck 8 of the tube, between the deflection device 2 and the gun 4.

Figure 2B:
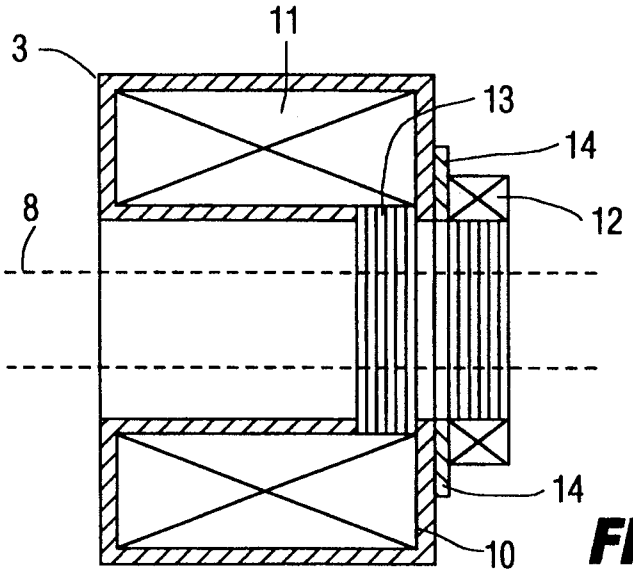
FIGS. 2*a* and 2*b* represent longitudinal sections along the main axis Z of the tube, of known magnetic focusing devices.
Figure 3B:
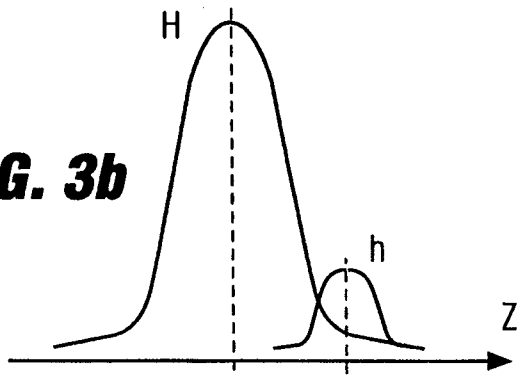
FIGS. 3*a* and 3*b* show the profiles along the axis Z of the focusing fields created by the devices of FIGS. 2*a* and 2*b;*
Figure 2A:
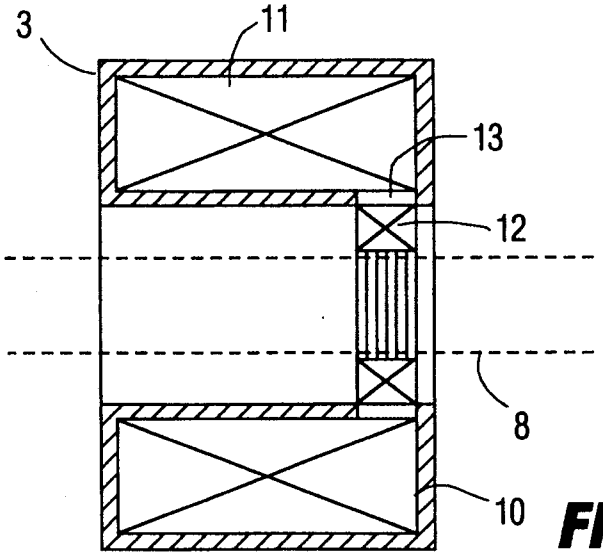
Figure 3A:
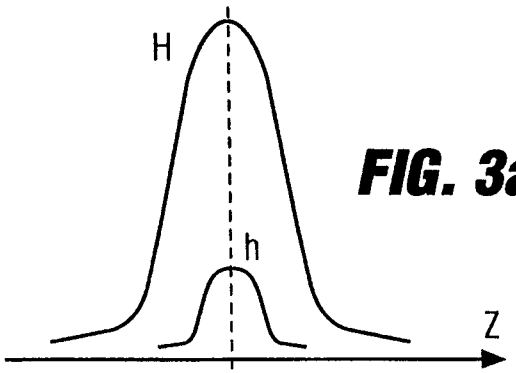

In the embodiment of the focusing device 3 described in the prior art and illustrated by FIGS. 2*a* and 3*a,* the static coil 11, placed on the neck 8 of tube 1, is enclosed in a frame 10 open toward a gap 13, at which the static field H appears. The dynamic focusing coil 12 is placed at the level of the gap in order that the fields h and H will act at the same place on the axis Z, to optimize the action of the field h created by the dynamic focusing coil. The frame 10 is generally made of soft iron, a material having a weak remnant field; an essential characteristic for obtaining an identical action of the magnetic lens created by field H with each operation of the focusing system. However, the device of FIG. 2*a* presents the following limitations:

(1) The field h created by the dynamic coil 12 is enclosed in the magnetic circuit 10. An electric coupling then occurs between coils 11 and 12, modifying in particular the amplitude of field H over time.

(2) The currents induced by coil 12 in the soft iron circuit 10 become strong, resulting in prohibitive losses of energy due to the low resistivity of soft iron, on the order of 10 μohm/cm. It is believed in this connection that a resistivity of at least 1 ohm/cm would be desirable for obtaining negligible electric losses.

In another solution according to the prior art, illustrated by FIGS. 2*b* and 3*b*, the dynamic focusing coil 12 is offset relative to the gap 13, such that the zones of action of the fields H and h along the axis Z overlap a little. A piece of mu-metal 14, a few tenths of a millimeter thick, insulates coil 12 magnetically from the soft iron frame 10 so that a very weak coupling between coils 11 and 12 results. The position of coil 12 causes its action on field H to be less sensitive than in the case described by FIG. 2*a*. It is therefore necessary to increase the value of the current in 12 to obtain an equivalent modulation of H, making it mandatory to furnish a high energy unacceptable in an operation at high frequency. Moreover, the losses by Foucault currents are still very high due to the low resistivity of the mu-metal (on the order of 50 μohm/cm).

It has been noted also that prior art devices experience a problem of magnetic drag brought about by the time shift between the current flowing in 12 and the field created by this current. The magnetic drag causes a focusing asymmetry between the extreme points of one and the same line. This shift is caused by the poor dynamic behavior of the materials in which the field h is enclosed; soft iron in one case, mu-metal in the other. Thus, in the device described by FIG. 2*b*, the time it takes the field to establish itself at 99.9% of the value that it should have is on the order of 20 microseconds.

Figure 4B:
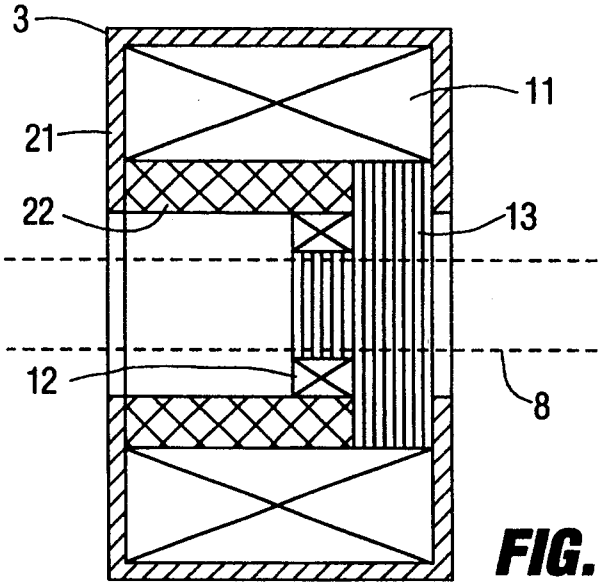
FIGS. 4*a* and 4*b* are representations in longitudinal section along the axis Z of magnetic focusing devices according to the invention.
Figure 4D:
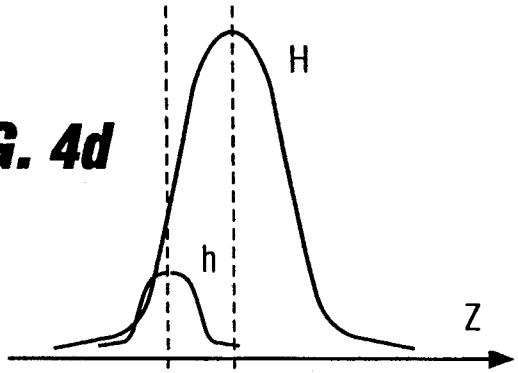
FIGS. 4*c* and 4*d* are the profiles along the axis Z of the focusing fields created by the devices of FIGS. 4*a* and 4*b,* respectively.
Figure 4A:
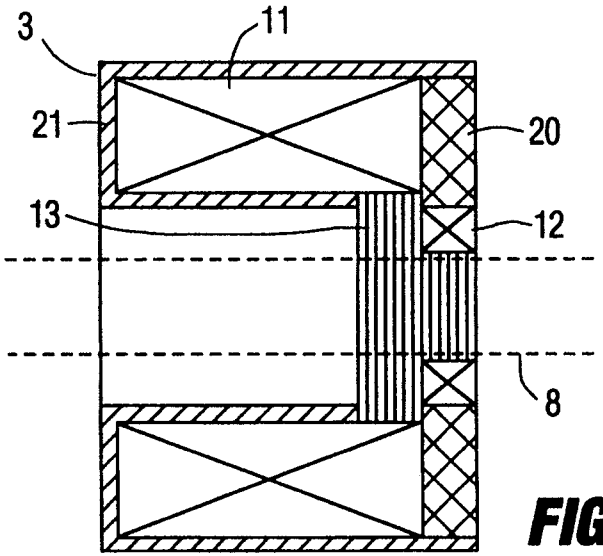
Figure 4C:
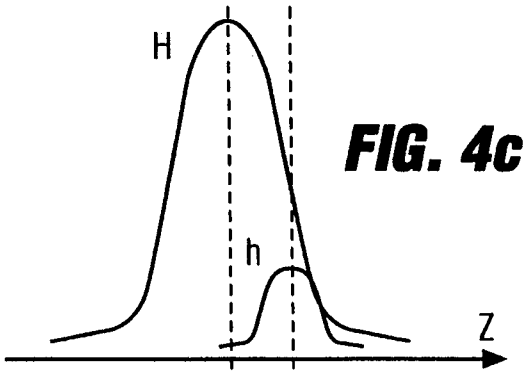

The device of FIG. 4*a* illustrates an embodiment of the present invention in which the fields H of the static focusing coil 11 and h of the dynamic focusing coil 12 have shifted zones of action, along the main axis Z of the tube. The two coils are so arranged that the zone of action of field h is mostly within the zone of action of field H. Accordingly, coil 12 is arranged near the gap 13 made by interruption of the magnetic circuit which constitutes the substantially toroidal frame surrounding coil 11. This configuration is possible, and effective, by making the frame in two parts 20 and 21, the constituent materials of which have different magnetic permeabilities, particularly at frequencies equal to or higher than 16 kHz.

The permeability of a material is generally constant up to a certain frequency, at which skin effects become noticeable. To represent the frequency behavior of this material it is customary to treat its magnetic permeability as a complex function expressed thus:

$$\mu=\mu'-j\mu''$$

where $\mu'$ is a function of the frequency characterizing the magnetization of the material and $\mu''$ is another function of the frequency characterizing the magnetic losses in the interior of this material.

Experience has shown that the choice of soft iron for making part 21 of the frame and ferrite for making part 20 gives excellent results. The two parts 20 and 21 are arranged on either side of the gap. The ferrite piece 20 has, for reasons of ease of manufacture and assembly, a crown-shaped form constituting a wall of the frame surrounding coil 11, perpendicular to the axis Z of the tube. Coil 12 is arranged, at the same time, closest to the neck of the tube, for optimum action on the electron beam with a minimum of current, and under the ferrite piece. In this manner, the magnetic field created by coil 12 is enclosed almost exclusively in the ferrite 20 and not in the circuit of soft iron. This results in a very weak coupling between coils 11 and 12.

The analysis of the frequency behavior of ferrite, illustrated by FIG. 6, shows that it presents a permeability whose real time $\mu'$ remains high (about 2000) up to frequencies on the order of 1 MHz, while its imaginary value $\mu''$, responsible for the magnetic losses, remains low up to frequencies close to 200 kHz. Moreover, the phenomena of magnetic drag is in this case very weak because the time it takes the field to establish itself at 99.9% of the value that it should have is on the order of microseconds. Lastly, the losses due to the current induced in the ferrite remain small, as the resistivity of ferrite is around 100 ohm/cm.

The ferrite used for making the piece 20 is manufactured by LCC-Cie Européenne de Composants Electroniques and referenced under the number T22.

In another embodiment of the invention illustrated in FIG. 4*b*, the ferrite piece constitutes the wall of the magnetic frame surrounding the static coil 11 situated closest to the neck 8 of the tube. The ferrite piece in this embodiment is in the form of a cylindrical tube 22 whose transverse axis coincides with the main axis Z of the tube. Coil 12 is, as in the preceding case, situated under the ferrite piece, closest both to the neck 8 of the tube and to the edge of the gap 13.

What is claimed is:

1. A magnetic focusing device adapted for mounting around the neck of a cathode ray tube, comprising:

a static focusing coil energized by a direct current:

a magnetic frame enclosing said static focusing coil and formed of pieces, a first one of said pieces having a magnetic permeability higher than in any other piece of said frame, said first one of said pieces having a first surface facing said static focusing coil, a second surface facing said neck and a third surface forming one side of a gap in said frame facing said neck;

and, a dynamic focusing coil energized by a periodically variable current and disposed radially inwardly of said static focusing coil, between said second surface of said first one of said pieces and said neck of said tube.

2. A device according to claim 1, wherein a second one of said pieces of said frame, having a lower magnetic permeability than said first one of said pieces, forms another side of said gap.

3. A device according to claim 1, wherein said dynamic focusing coil is disposed near said gap of said magnetic frame enclosing said static coil.

4. A device according to claim 1, wherein a magnetic field created by said dynamic focusing coil uses said first one of said pieces of said frame as a magnetic circuit.

5. A device according to claim 1, wherein said first one of said pieces of said frame is formed as a crown centered on the main axis of said tube and disposed in a plane perpendicular to the main axis.

6. A device according to claim 1, wherein said first one of said pieces of said frame is formed as a cylindrical tube whose transverse axis coincides with the main axis of said tube.

7. A device according to claim 1, wherein said first one of said pieces of said frame is ferrite and all other pieces of said frame are soft iron.

8. A device according to claim 1, wherein said first one of said pieces of said frame has a resistivity of at least approximately 1 ohm/cm.

9. A device according to claim 1, in combination with said cathode ray tube.

10. A magnetic focusing device adapted for mounting around the neck of a cathode ray tube having a main axis, comprising:

a magnetic frame having a gap in a portion thereof radially closest to the neck;

a static focusing coil enclosed in said magnetic frame and creating a first focusing field in a first zone of action along said main axis of said tube when energized by a direct current, said first zone of action having a maximum field strength at a point along said main axis;

a dynamic focusing coil disposed radially inwardly of said static coil and creating a second focusing field in a second zone of action along said main axis of said tube when energized by a variable current of a period equal to or higher than approximately 16 kHz; and, said second zone of action of said second field created by said dynamic focusing coil substantially falling within said first zone of action, but being shifted along said main axis of said tube substantially to one side of said point of maximum field strength of said first zone of action.

11. A device according to claim 10, in combination with said cathode ray tube.

12. A magnetic focusing device adapted for mounting around the neck of a cathode ray tube, comprising:

a static focusing coil for generating a static focus field when energized by a direct current;

a dynamic focusing coil disposed between said static focusing coil and said neck of said tube for generating a dynamic focus field when energized by a periodically variable current; and, a magnetic circuit for said static focusing coil formed by a magnetic frame having pieces enclosing said static focusing coil except for an air gap, one of said pieces having a higher magnetic permeability than any other of said pieces and also forming a magnetic circuit for said dynamic focusing coil.

13. A device according to claim 12, wherein said one piece having said higher magnetic permeability forms one side of said air gap and another one of said pieces, having a lower magnetic permeability, forms the other side of said air gap.

14. A device according to claim 12, wherein said one piece of higher magnetic permeability is ferrite and said other pieces of said frame are soft iron.

15. A device according to claim 12, in combination with said cathode ray tube.

* * * * *